US009683778B2

(12) United States Patent
Anderson et al.

(10) Patent No.: US 9,683,778 B2
(45) Date of Patent: Jun. 20, 2017

(54) SOLVENT SCAVENGER FOR A DESOLVENTIZER TOASTER USING A VAPOR RECOVERY SYSTEM

(75) Inventors: George E. Anderson, Champlin, MN (US); Benjamin W. Floan, Andover, MN (US)

(73) Assignee: Crown Iron Works Company, Roseville, MN (US)

( * ) Notice: Subject to any disclaimer, the term of this patent is extended or adjusted under 35 U.S.C. 154(b) by 1027 days.

(21) Appl. No.: 13/455,977

(22) Filed: Apr. 25, 2012

(65) Prior Publication Data

US 2012/0266489 A1 Oct. 25, 2012

Related U.S. Application Data

(60) Provisional application No. 61/478,799, filed on Apr. 25, 2011, provisional application No. 61/479,096, filed on Apr. 26, 2011.

(51) Int. Cl.

| | |
|---|---|
| ***F26B 3/00*** | (2006.01) |
| ***F26B 17/00*** | (2006.01) |
| ***F26B 21/00*** | (2006.01) |

(52) U.S. Cl.

CPC ..... *F26B 17/003* (2013.01); *F26B 21/00* (2013.01)

(58) Field of Classification Search

CPC ..... F26B 17/003; F26B 21/00; F26B 17/00; F26B 3/00; F26B 25/18

USPC ..... 34/588, 505, 165–168, 487, 218, 498, 34/502, 509, 513

See application file for complete search history.

(56) References Cited

U.S. PATENT DOCUMENTS

| | | | | |
|---|---|---|---|---|
| 3,126,285 | A | 3/1964 | Lippold | |
| 4,168,418 | A | 9/1979 | Bird | |
| 4,622,760 | A | 11/1986 | Schumacher | |
| 5,301,602 | A | 4/1994 | Ryczek | |
| 6,279,250 | B1 * | 8/2001 | Anderson | 34/526 |
| 2008/0115309 | A1 * | 5/2008 | Pan et al. | 15/300.1 |

(Continued)

FOREIGN PATENT DOCUMENTS

| | | |
|---|---|---|
| EP | 1 336 426 A1 | 8/2003 |
| EP | 1336426 A1 | 8/2003 |

(Continued)

OTHER PUBLICATIONS

Anderson, George, Introducing the Vapor Recovery System, Inform, vol. 14, Jun. 2003, pp. 338-339.

(Continued)

*Primary Examiner* — Kenneth Rinehart
*Assistant Examiner* — John McCormack
(74) *Attorney, Agent, or Firm* — Fredrikson & Byron, P.A.

(57) ABSTRACT

An improved desolventizer-toaster (DT) unit is used for removing traces of a hydrocarbon solvent from a mass of vegetable particles of oil. A conventional DT unit has within a housing, a set of solvent removal trays and a main ejector transporting solvent vapor and steam from below the tray set to between a pair of the trays in the set. The improved DT unit has a further scavenger tray between an inlet of the main ejector and the housing floor. A scavenger ejector transports solvent vapor from between the scavenger tray and the housing floor before it exits from the unit, to the space between the tray set and the scavenger tray.

9 Claims, 1 Drawing Sheet

(56) References Cited

U.S. PATENT DOCUMENTS

2010/0088923 A1 4/2010 Lopez

FOREIGN PATENT DOCUMENTS

WO WO 2007/032708 A1 3/2007
WO WO-2010141053 A1 12/2010

OTHER PUBLICATIONS

Copenheaver, Blaine R., PCT International Search Report and Written Opinion of the International Searching Authority, PCT Application No. PCT/US2012/035195, Aug. 13, 2012.
Moon, Kihwan, PCT International Preliminary Report on Patentability, PCT Application No. PCT/US2012/035195, Nov. 7, 2013.
Etienne, Nicolas, Supplementary European Search Report under Art. 153(7) for EPC Appl. No. 12777205.1, Oct. 10, 2014.
The State Intellectual Property Office of the People's Republic of China, Notice of First Office Action, Chinese Patent Application No. 201280028919.0, Nov. 4, 2014.

* cited by examiner

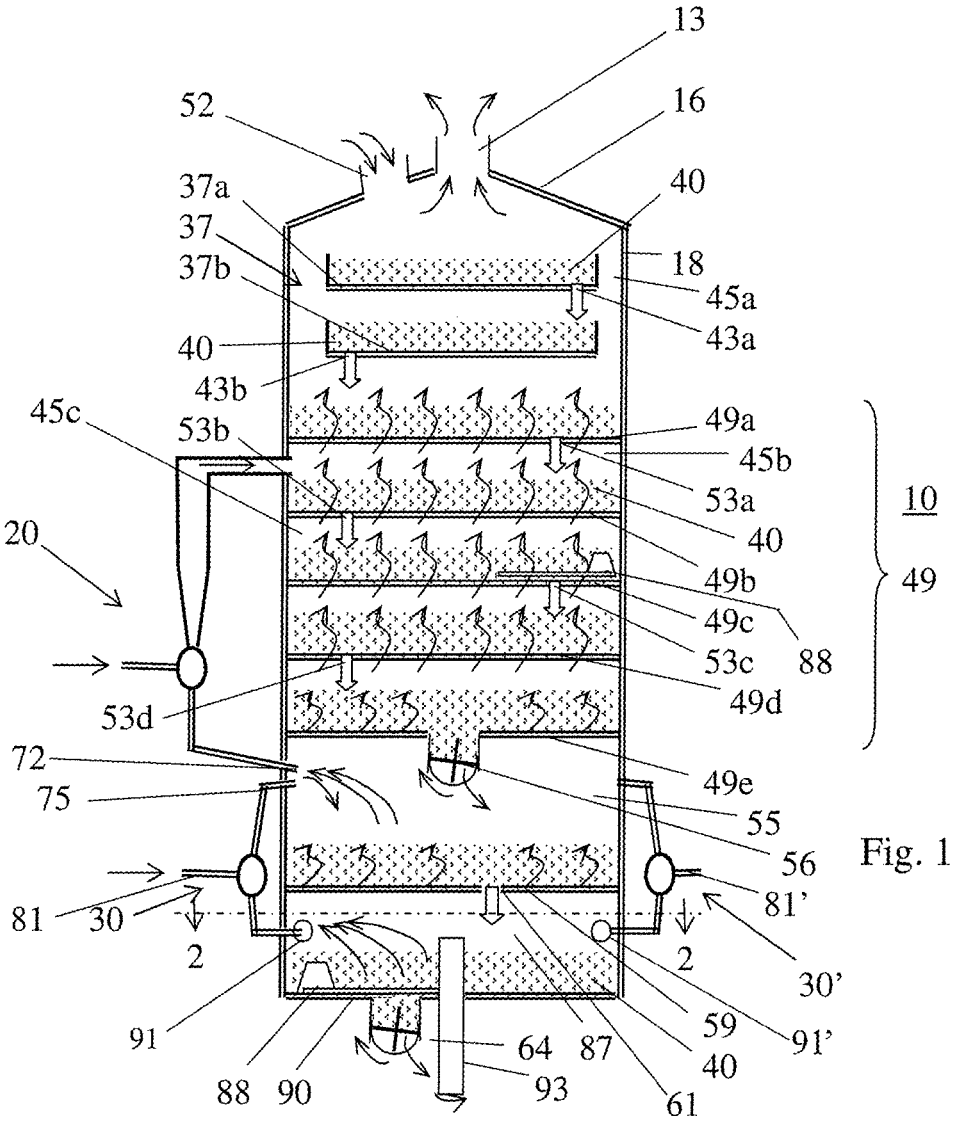
Fig. 1
Fig. 2
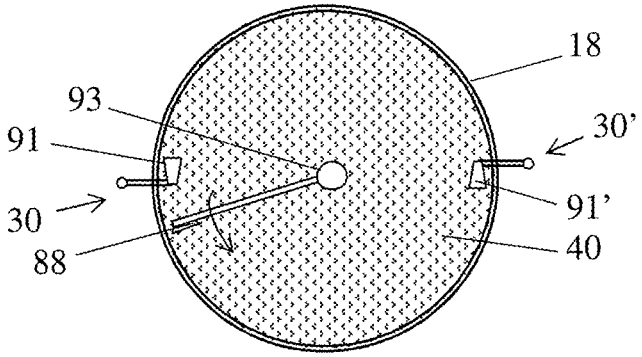

SOLVENT SCAVENGER FOR A DESOLVENTIZER TOASTER USING A VAPOR RECOVERY SYSTEM

CROSS REFERENCE TO RELATED APPLICATIONS

This is a regular application filed under 35 U.S.C. §111(a) claiming priority, under 35 U.S.C. §119(e)(1), of provisional application Ser. No. 61/478,799, previously filed Apr. 25, 2011, under 35 U.S.C. §111(b) and provisional application Ser. No. 61/479,096, previously filed Apr. 26, 2011, under 35 U.S.C. §111(b).

BACKGROUND OF THE INVENTION

One very important industrial process is the extraction of vegetable oil from oil-bearing seeds or kernels such as soybeans, cottonseed, canola, and rapeseed. The process generally operates continuously in very large equipment, where a single unit typically extracts many tons per day of the oil. The oil is very valuable, and has many food and non-food uses. The particle mass remaining after the oil removal is also valuable, and may be used as human food or animal feed.

One type of extraction system first processes the oil-containing portion of the seeds to form a mass of flakes or particles bearing the oil (meal). Then the meal is transported to a container where a solvent such as hexane dissolves the oil in the meal. Much of the solvent-oil solution so formed is then removed from the meal by draining. The process then separates the oil and solvent removed from the meal by distillation for example, allowing the oil to be used as desired, and the solvent reused.

Hexane and other similar solvents are highly flammable, so the processes used must avoid any possibility of igniting the hexane. Hexane and other solvents also form vapors much heavier than air and water vapor, so solvent vapors tends to settle at the bottom of any vessel containing them.

The meal after the first solvent-oil removal step still has so much solvent that the meal is unfit for use as animal feed or human food. To correct this situation, a "desolventizer-toaster" (DT) unit may remove a large percentage of the remaining solvent from the meal. This leaves the remaining meal with a small amount of residual solvent. The solvent that the DT unit extracts from the meal can be reused in the process as well, making the process more cost-efficient and environmentally friendly.

A DT unit passes the meal through a number of heating stages that vaporize nearly all of the solvent remaining in the meal. Each stage comprises a floor or tray that heats the meal and/or allows steam to pass through the meal, in either case vaporizing a portion of the hexane or other solvent in the meal. A stifling element at each stage agitates the meal to assist the vaporization and to eventually shift the meal to an opening in the stage's floor through which the meal falls under the force of gravity to the next stage.

Each stage can remove only a percentage of the solvent remaining in the meal. DT units having a reasonable number of stages, say 6-10, do not remove as much of the solvent as desired to provide meal with a suitably small amount of solvent.

Certain newer DT units now have one or more solvent extraction flash stages at the bottom of the conventional heating stages that use a different process to extract a further percentage of the entrained solvent, meanwhile reusing a portion of the steam. This type of DT unit is explained in both U.S. Pat. No. 6,279,250 ('250) and in an article in Inform, June 2003, pp. 338-339 (Inform). Both '250 and Inform are incorporated by reference into this description.

It will be helpful for the reader of this description to be familiar with both of these publications. Such a solvent extraction and steam reuse stage form a Vapor Recovery (VR) enhancement of a DT unit.

This VR stage uses an ejector or other vapor transport device that collects steam and leaked solvent vapor from the rotary valve receiving meal discharged from the final conventional stage, see '250. The ejector recycles this steam and leaked solvent vapor back into an upper conventional stage of the DT unit. The stages at and below the stage receiving the recycled steam can reuse the thermal energy of the recycled steam rather than losing it. The heat in the recycled vapor will heat the meal to extract further solvent while again passing through the conventional stages, thereby reducing solvent lost to the environment and providing more solvent for reuse.

A DT unit having VR usually has only one VR stage as shown in '250. Some have however, been built with two or more VR stages in order to recover more of the solvent. Experience shows though, that in DT units with multiple VR stages, it is difficult to assure the most efficient venting of vapors from the plurality of VR stages. That is, it is difficult to find the optimum amount of steam and vapor to recycle from above the first VR stage and how much to recycle from above the second VR stage.

These conventional VR stages do not deal with the problem of pooling or gathering of the heavy solvent vapors due to inadequate agitating of the gasses in the space involved. Hexane for example, has a specific gravity that is more than five times that of water. If the steam and solvent vapors do not thoroughly mix, the heavier solvent vapors settle in the space and eventually exit the DT unit with the meal.

Experience also shows that conventional VR systems leave a small percentage of the solvent remaining in the meal. While this remaining solvent is not considered to affect the quality of the meal, it is still wasted. It would be advantageous to extract a further portion of this remaining solvent, for reuse if for no other reason.

BRIEF DESCRIPTION OF THE INVENTION

A desolventizer-toaster (DT) unit removes solvent from a mass of vegetable meal in the form of particles or flakes holding the solvent in liquid form in the meal. The DT unit is of the type having a floor and above the floor, a series of permeable vapor recovery (VR) trays including a bottom tray. Each VR tray receives steam for heating the meal and permeating the meal. The meal cascades downward through ports in the VR trays to a bottom tray. A mixture of the steam and vaporized solvent flows upwards through the permeable trays. The bottom VR tray and a floor of the unit each having a transport device for passing meal to the space below but resisting passage of vapors.

The DT unit further comprises a main ejector with an inlet in the space below the bottom tray and an outlet between adjacent VR trays above the bottom tray.

The invention is an improvement that allows removing a further fraction of the solvent remaining in the meal when it reaches the floor of the DT unit. This improvement includes a scavenger tray between the main ejector inlet and the floor. A first scavenger ejector has an inlet in the space between the scavenger tray and the floor and an outlet in the space between the scavenger tray and the bottom tray.

The scavenger ejector transports vapors in the space between the scavenger tray and the floor to the space between the bottom VR tray and the scavenger tray. Some of the vapors that pass through the scavenger ejector are then transported by the main ejector to spaces between the VR trays. Removal of a further fraction of solvent from the meal when it reaches the floor of the DT is enabled.

The present invention is thus an improved desolventizer-toaster (DT). More specific advantages of the invention will become apparent with reference to the DESCRIPTION OF THE PREFERRED EMBODIMENTS.

BRIEF DESCRIPTION OF THE DRAWING

FIG. 1 is an internal side elevation view of a multi-stage desolventizer-toaster (DT) unit with a final solvent scavenger stage.

FIG. 2 is a top plan view at a section of the final solvent scavenger stage.

DESCRIPTION OF THE PREFERRED EMBODIMENTS

FIGS. 1 and 2 show a DT unit 10 having many of the components shown in the '250 patent mentioned earlier. Unit 10 as shown in FIGS. 1 and 2 includes a housing or enclosure 16 characterized by a generally circularly cylindrical cross section and a sidewall 18 within which occurs removal of solvent from vegetable meal. Masses or layers 40 of meal are shown throughout housing 16 in various stages of solvent removal.

The stages of solvent removal comprise various vapor recovery (VR) trays 37*a* and 37*b*, 49*a* - 49*e*, and tray 59, collectively VR tray sets 37, 49, and 59 respectively. The tray sets 37, 49, and 59 all support layers of meal masses 40 as the meal passes through the unit 10.

Tray sets 37, 49, and 59 and floor 90 are all hollow. Steam flows into and through them to heat the meal masses 40 they hold to vaporize the solvent in the meal masses 40 on them. Both top and bottom plates forming trays 49*a* - 49*d* are porous to allow steam to percolate through the meal masses 40 held thereon, and to allow vapors from lower stages to also flow through. The upper plate of tray 49*e* is porous to allow steam to flow upwards through the mass 40 thereon, but the lower plate of tray 49*e* is non-porous to prevent flow of vapor from space 55.

Each tray and floor 90 has a stirrer 88, shown only for tray 49*c* and floor 90 in the FIGS. Stirrers 88 may each comprise for example, an arm and paddle blade driven by a shaft 93 causing stirrers 88 to rotate circularly around the upper surface of the trays in each tray set 37, 49, and 59. Stirrers 88 mix and agitate the individual meal masses 40 to maintain constant temperature therein, to release trapped solvent vapors, and to assist vaporizing the solvent in the masses 40.

Solvent-containing meal enters enclosure 16 through a port 52 at the top of enclosure 16 in a zone 45*a* within enclosure 16. The entering meal initially falls under the force of gravity onto to the upper surfaces of tray 37*a*. From tray 37*a*, the stirrers sweep meal masses 40 through the trays' respective openings 43*a*, etc. to cascade through enclosure 16 from each of the trays to the tray directly below prevents most vapor leakage upwards through tray 49*e*.

Stirrers 88 continuously sweep across individual trays of tray sets trays 37, 49, and 59 causing agitation of meal masses 40 held on trays 37, 49, and 59. Stirrers 88 also shift meal masses 40 to openings 43*a*, 43*b*, and 53*a*- 53*d*, through which the meal falls to the tray surface below. Block arrows at 53*a*- 53*d* represent this falling meal.

A transport device such as rotary valve 56 moves meal from tray 49*e* to tray 59. Such a transport device prevents most vapor leakage upwards through tray 49*e*.

The heated tray sets 37, 49, and 59 vaporize much of the solvent in the meal masses 40. The steam injected into trays of tray set 49 vaporizes much of the solvent in the masses 40 thereon to form a solvent-steam vapor. Much but not all of this solvent-steam vapor exits through vent 13. Equipment receiving the gasses from vent 13 maintain a pressure lower than that within housing 16, as for example by condensing the solvent-steam vapor in the course of separating the oil and solvent.

'250explains how (referring to FIG. 1 of this description) main ejector 20 introduces high-temperature steam into space 45*b* to increase the amount of solvent in mass 40 on bed 49*a* that is vaporized. Main ejector 20 is a "medium pressure ejector" that pulls in vapor at approximately atmospheric pressure and has sufficient pressure rise, perhaps between 6" water column (.22 psi positive pressure and 70" wc (2.5 psi) positive pressure. The precise pressure rise depends on the size of the plant, total number of trays, etc.

The term "ejector" here should be taken to include not only those gas transport devices that use momentum transfer between a steam jet and the solvent vapor, but also other types of pumps and fans that accomplish similar transport of the gasses at the ejector inlet to the ejector outlet. Because of the flammability of oil solvents such as hexane, it is likely that steam-based ejectors are preferable, since they mostly avoid the possibility of a spark within the ejector itself.

Port 61 in tray 59 allows meal with entrained liquid solvent and any of the heavier solvent vapors to fall onto floor 90 as the stirrer for tray 59 shifts and mixes the meal lying on tray 59. The solvent in the space above tray 59, being substantially denser than steam, also tends to flow through port 61.

A transport device such as rotary valve 64 prevents most vapor leakage upwards through floor 90 from outside chamber 16. Valve 64 is at the bottom of housing 16 in the FIG. and shown in '250 as valve 58, removes masses of meal from space 87 while allowing only a small amount of air to enter space 87. Because of the high specific gravity of solvent vapor (in the case of hexane, nearly 5 times as heavy as steam), space 87 between floor 90 and tray 59 tends to accumulate solvent vapor. Then, as meal moves through rotary valve 64, solvent vapor can escape with the meal.

The invention includes an additional solvent vapor transfer and mixing device comprising tray 59, a first scavenger ejector 30, and a second optional scavenger ejector 30' preferably diametrically located from ejector 30 on housing 16. Ejectors 30 and 30' carry vapors from space 87 into space 55, and also enhance circulation of the vapors in space 87. Ejector 30 is preferably one with relatively low pressure rise. Ejector 30' has a similar structure and operation.

Ejectors 30 and 30' may have bell-shaped inlet openings 91 and 91' that are substantially larger than the duct leading into the respective ejector 30 or 30'. Such inlets 91 and 91' should be directed in a generally tangential direction, with reference to the nearby wall of housing 16, should face toward or upstream relative to the movement of vapors circulating as a result of stirrer 88 movement. The added areas of the inlet openings 91 and 91' may pull more solvent vapor into the ejectors 30 and 30'.

Steam flows into ejector 30 through pipe 81 and into ejector 30' through pipe 81'. The steam flow supplies momentum to any solvent vapor molecules to carry them into space 55. Ejector 30 outlet 75 is preferably located close to the inlet 72 of main ejector 20.

FIG. 2 shows the stirrer 88 in space 87 in the form of a stirring arm rotating circularly around the upper surface of scavenger tray with counterclockwise rotation. The inlet openings 91 and 91' preferably face opposite the direction of stirring arm rotation.

Movement of stirrers 88 generates a slow counterclockwise rotational movement of the vapors in space 87. The openings 91 and 91' preferably face against this rotational movement to gather added amounts of solvent vapors for transfer to space 55.

The pressure in space 55 in the vicinity of the exit for duct is substantially the same as the pressure within space 87. Ejectors 30 and 30' transfer some of the solvent vapor in space 87 to space 55. Main ejector 20 in recirculating vapor from space 55 to space 45*b*, also then transfers some of the solvent vapor that previously was in space 87.

By placing at least one outlet 75 near inlet 72, this transfer is enhanced. In any case, some of this vapor that was within space 87 then will flow upwards and exit housing 16 through vent 13.

It may be possible to provide more than two of these scavenger ejectors to eliminate any stagnant pockets in space 87 in which heavy hexane settles. But even one of these ejectors 30 and 30' enhances circulation of vapors, allowing their transport by electors 30 and 30' into space 55, where they may be further transported into the intermediate tray set 49.

The motive steam for both ejector 30 and main ejector 20 is almost completely collected by main ejector 20 and forced back to an early stage of set 49 to recycle through unit 10. Its energy is thus almost completely re-used to vaporize solvent in the meal masses 40. There is thus little energy cost associated with operating a unit 10 with one or more scavenger ejectors 30 and 30'. In fact, considerable energy is saved by the recovery of the steam and solvent in space 87 which would otherwise be lost to the discharge conveyors.

The net result of these features is to reduce the solvent lost to the environment, to require less fresh solvent to be purchased at processing plants, and to do this with robust, simple, reliable, easy to control, low cost, low energy-consuming apparatus.

The invention claimed is:

1. A desolventizer-toaster (DT) unit for removing liquid solvent from a mass of vegetable meal, the DT unit comprising:

a floor, and above the floor, a series of permeable intermediate trays and a bottom tray, each intermediate tray receiving steam for heating and permeating the mass of vegetable meal, and through which cascades downward, through ports therein, the mass of vegetable meal to a bottom tray, and through which upwardly flows a mixture of the steam and vaporized solvent, the bottom tray and the floor of the DT unit each having a transport device for passing the mass of vegetable meal to a space below while resisting passage of vapors;

a main ejector with an inlet in the space below the bottom tray and an outlet between adjacent trays above the bottom tray, a scavenger tray between the main ejector inlet and the floor; and, a first scavenger ejector having an inlet in the space between the scavenger tray and the floor and an outlet in the space between the scavenger tray and the bottom tray.

2. The DT unit of claim 1, wherein the first scavenger ejector outlet is located adjacent to the main ejector inlet.

3. The DT unit of claim 2, including a second scavenger ejector spaced from the first scavenger ejector and having an inlet in the space between the scavenger tray and the floor and an outlet in the space between the scavenger tray and the bottom tray.

4. The DT unit of claim 3, wherein the inlet comprises an opening generally facing along a line tangent to the housing wall in the vicinity of the inlet.

5. The DT unit of claim 4, including a stirring arm moving circularly around the upper surface of the scavenger tray, and wherein the inlet opening faces opposite the direction of stirring arm movement.

6. The DT unit of claim 5, wherein the inlet opening is bell-shaped.

7. The DT unit of claim 1, wherein the inlet comprises an opening generally facing along a line tangent to the housing wall in the vicinity of the inlet.

8. The DT unit of claim 1, wherein the main ejector and first scavenger ejector are each configured to provide momentum transfer between a steam jet and solvent vapor.

9. The DT unit of claim 1, wherein the transport device is a rotary valve.

* * * * *